US012317979B1

(12) United States Patent
Knight

(10) Patent No.: US 12,317,979 B1
(45) Date of Patent: Jun. 3, 2025

(54) PROTECTIVE CASE FOR ASTROPHOTOGRAPHY CAMERAS

(71) Applicant: Miscellaneous Nerdery LLC, Twentynine Palms, CA (US)

(72) Inventor: Damen Knight, Twentynine Palms, CA (US)

(73) Assignee: MISCELLANEOUS NERDERY LLC, Twentynine Palms, CA (US)

( * ) Notice: Subject to any disclaimer, the term of this patent is extended or adjusted under 35 U.S.C. 154(b) by 0 days.

(21) Appl. No.: 19/074,585

(22) Filed: Mar. 10, 2025

(51) Int. Cl.
*A45C 11/38* (2006.01)

(52) U.S. Cl.
CPC ..... *A45C 11/38* (2013.01)

(58) Field of Classification Search
CPC ..... A45C 11/38
USPC ..... 206/316.2
See application file for complete search history.

(56) References Cited

U.S. PATENT DOCUMENTS 4,549,589 A * 10/1985 Nguyen ..... A45C 11/38 206/810
5,199,563 A * 4/1993 Goodman ..... A45C 11/38 206/592
8,260,128 B1 * 9/2012 Sturm ..... G03B 17/56 396/27
2009/0114555 A1 * 5/2009 Wu ..... G03B 17/56 206/316.2
2010/0147715 A1 * 6/2010 Miglioli ..... A45C 13/008 206/316.2
2022/0137490 A1 * 5/2022 Lord ..... A45F 4/00 396/419

* cited by examiner

*Primary Examiner* — Jacob K Ackun

(74) *Attorney, Agent, or Firm* — Ansari Katiraei LLP; Arman Katiraei; Sadiq Ansari

(57) ABSTRACT

Provided is a protective case for an astrophotography camera. The protective case includes an inner sleeve and an outer sleeve. The inner sleeve has an open bottom end, a cylindrical housing, a top end, first apertures disposed about the cylindrical housing and the top end, and slits that extend vertically about an exterior of the cylindrical housing. The inner sleeve is made of a flexible plastic. The outer sleeve has second apertures and rails about an interior of the outer sleeve that slide into the slits about the exterior of the inner sleeve. The second apertures align with the first apertures as a result of sliding the rails of the outer sleeve onto the slits of the inner sleeve. The outer sleeve is made of a rigid plastic.

18 Claims, 11 Drawing Sheets

PROTECTIVE CASE FOR ASTROPHOTOGRAPHY CAMERAS

BACKGROUND

An astrophotography camera is a specialized type of camera that is designed to attach to a telescope and capture images with long exposure times in low-light conditions. The astrophotography camera contains sensitive optics to maximize light sensitivity and to minimize noise, and may include or operate in conjunction with electronics for tracking the movement of celestial objects in the sky during the long exposure times.

Drops, hard impacts, or other large shocks may damage the astrophotography camera and render the camera useless. Due to the high cost of these astrophotography cameras (e.g., thousands of dollars), there is need to protect the astrophotography cameras from damage caused by drops, hard impacts, or other large shocks.

DETAILED DESCRIPTION OF PREFERRED EMBODIMENTS

The following detailed description refers to the accompanying drawings. The same reference numbers in different drawings may identify the same or similar elements.

Provided are protective cases for astrophotography cameras. The protective cases protect the cameras from damage in the event of the drops, hard impacts, or other large shocks to the cameras.

The protective cases are made of a soft and flexible shock absorbing inner sleeve that slides onto or over the outer case of an astrophotography camera, and a hard outer sleeve that slides onto or over the inner sleeve. The protective cases are designed to remain on the astrophotography cameras when the camera is not in use and is being transported apart from other equipment (e.g., a telescope) and when the camera is in use without interference during use. For instance, the protective cases do not interface with the attachment of the camera to a telescope via an attachment tray, mounting plate, or other mounting hardware.

Figure 1:
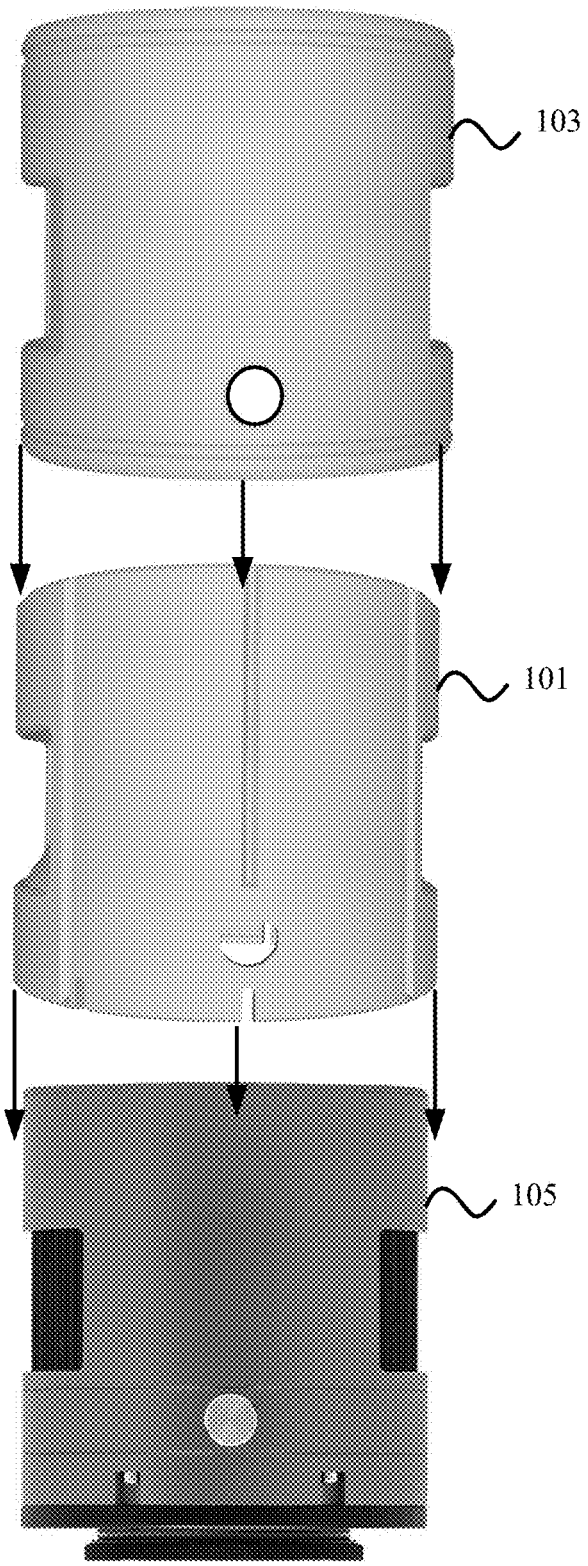
FIG. 1 illustrates an exploded view of an example protective case for an astrophotography camera in accordance with some embodiments presented herein.

FIG. 1 illustrates an exploded view of an example protective case for an astrophotography camera in accordance with some embodiments presented herein. The exploded view includes inner sleeve 101 and outer sleeve 103 of the example protective case. Inner sleeve 101 and outer sleeve 103 have an exposed bottom side and a cylindrical shape that match the cylindrical shape of astrophotography camera 105 presented in FIG. 1. In some embodiments, inner sleeve 101 and outer sleeve 103 have different shapes and dimensions to match different shapes and dimensions of other astrophotography cameras.

In some embodiments, inner sleeve 101 may be placed over astrophotography camera 105, and then outer sleeve 103 may be placed over inner sleeve 101 in order to fit the protective case on astrophotography camera 105. In some other embodiments, inner sleeve 101 may be inserted into outer sleeve 103, and then the combination of the inner sleeve 101 within outer sleeve 103 may be slid onto or over astrophotography camera 105 in order to fit the protective case on astrophotography camera 105.

Figure 2:
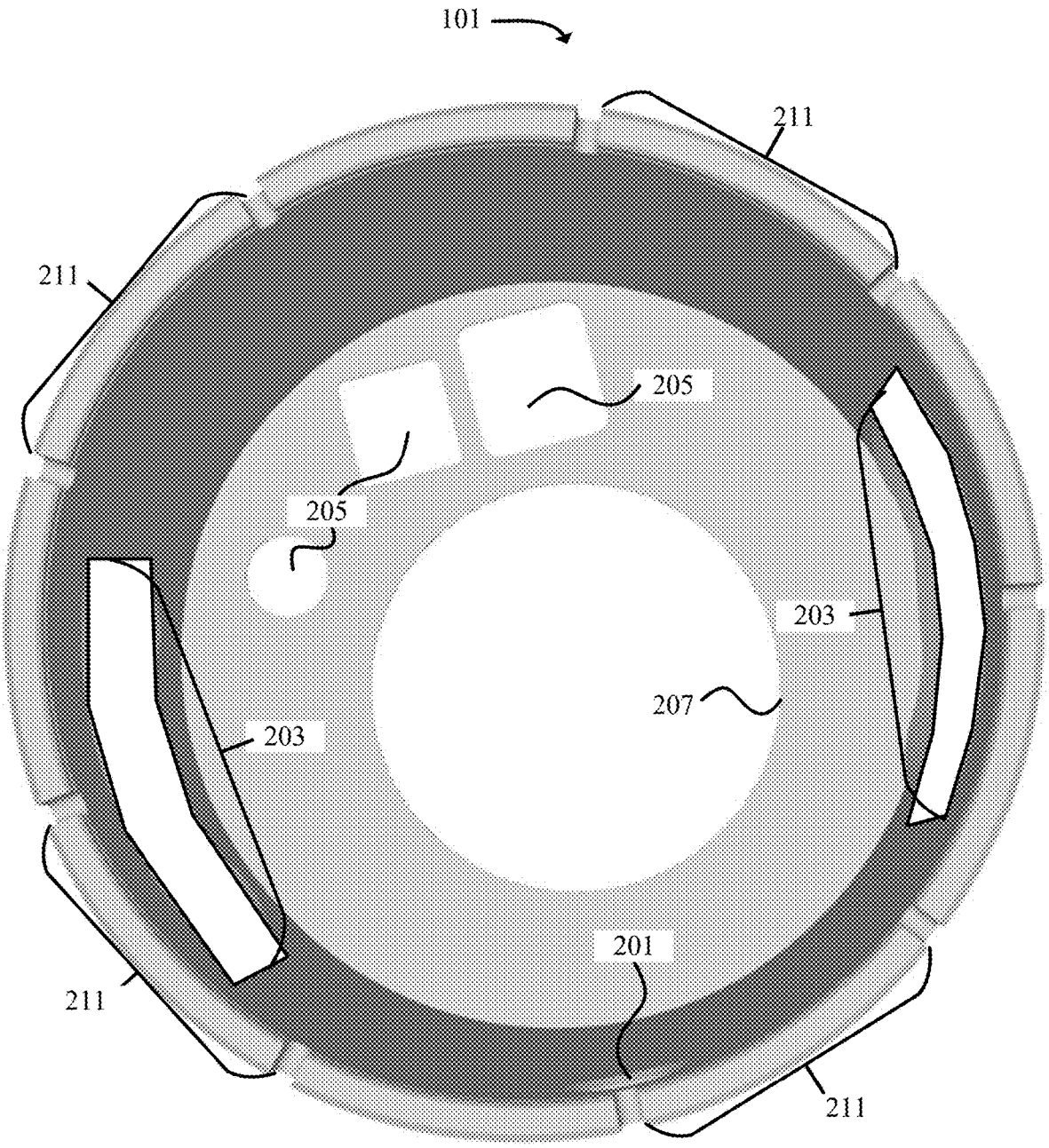
FIG. 2 illustrates a bottom view of the protective case inner sleeve in accordance with some embodiments presented herein.
Figure 3:
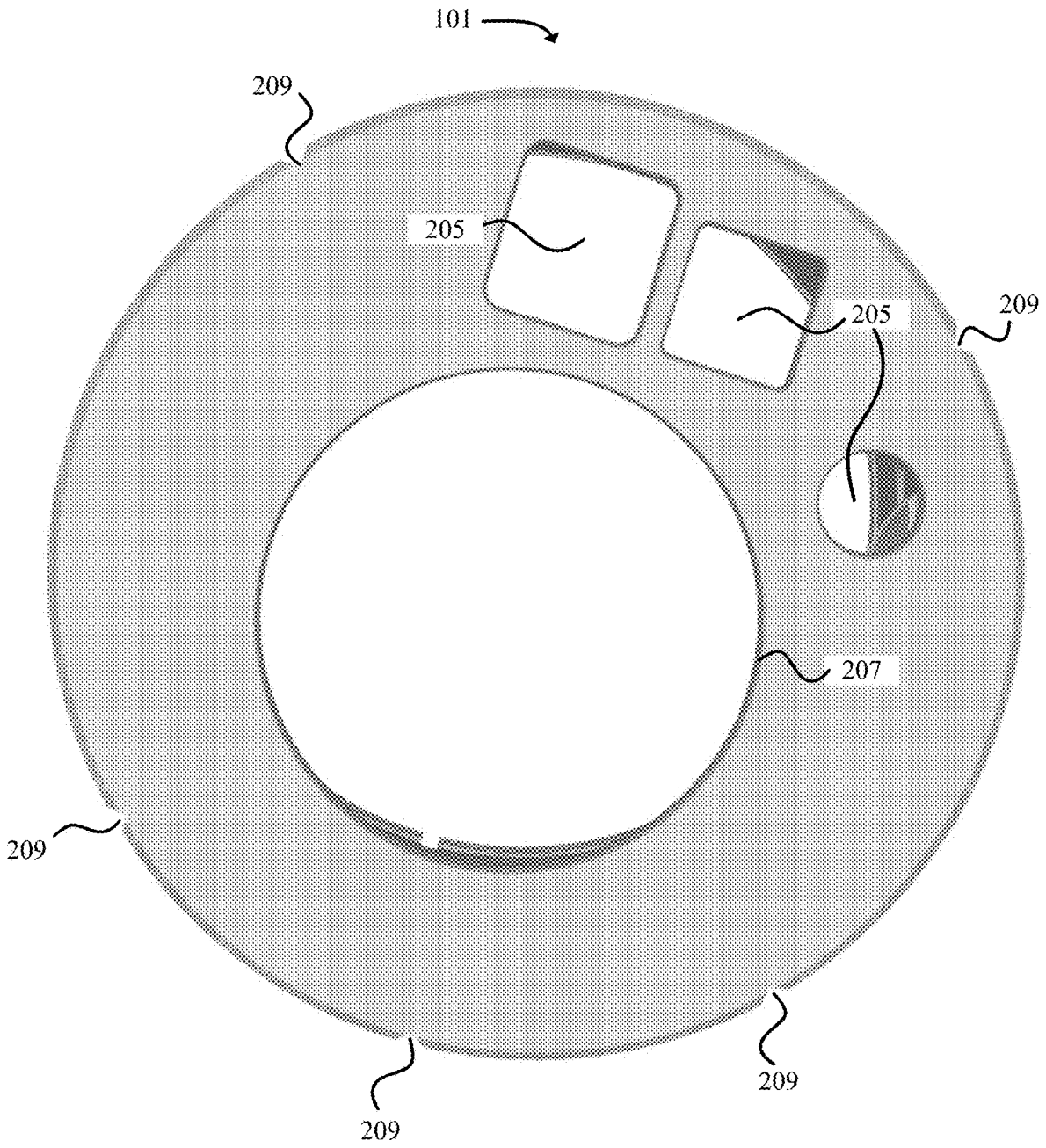
FIG. 3 illustrates a top view of the inner sleeve in accordance with some embodiments presented herein.
Figure 4:
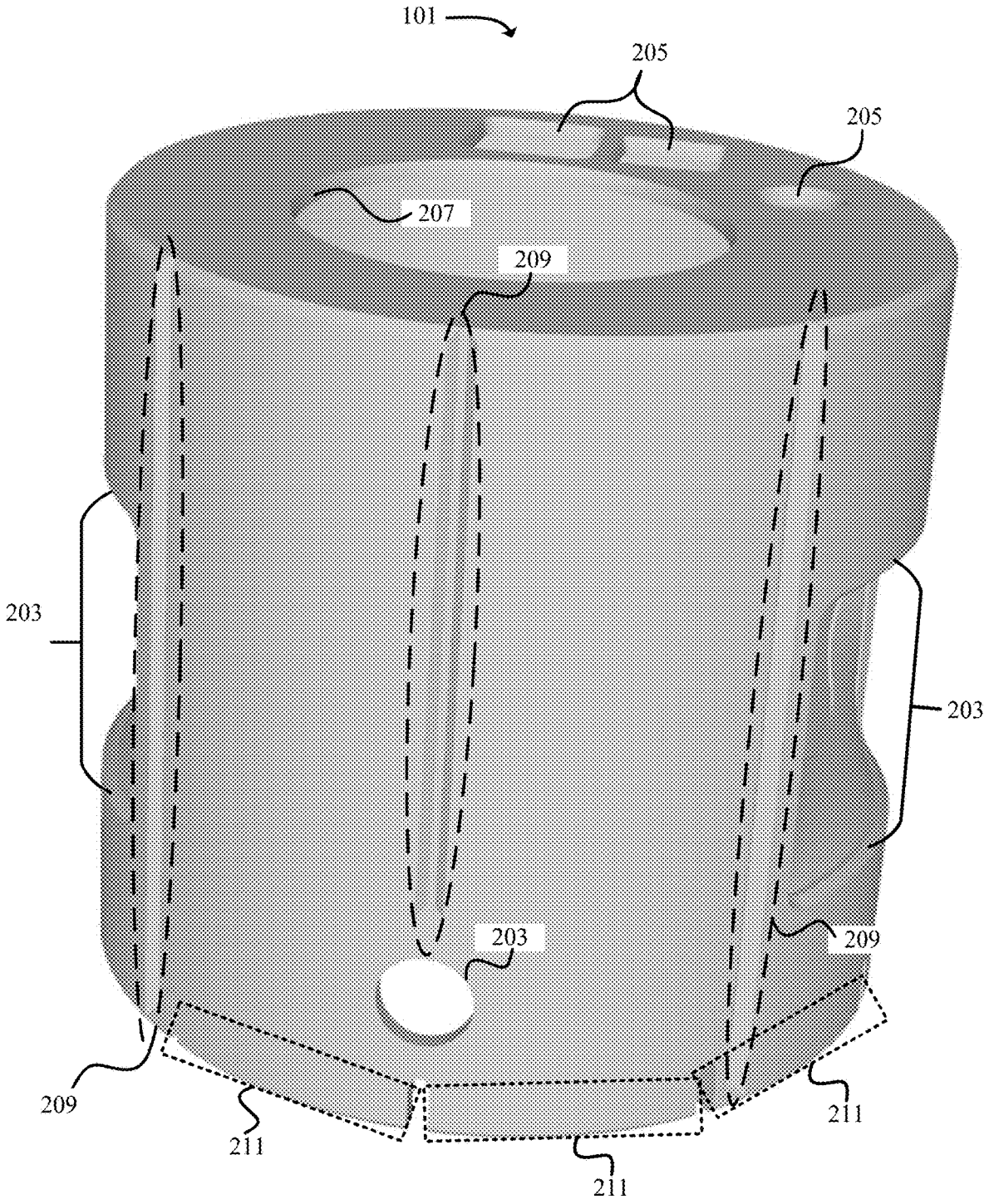
FIG. 4 illustrates the inner sleeve from a side perspective view in accordance with some embodiments presented herein.

FIG. 2 illustrates a bottom view of inner sleeve 101 in accordance with some embodiments presented herein. FIG. 3 illustrates a top view of inner sleeve 101 in accordance with some embodiments presented herein. FIG. 4 illustrates inner sleeve 101 from a side perspective view in accordance with some embodiments presented herein.

Inner sleeve 101 is a cylindrical housing that conforms to the shape and dimensions of the astrophotography camera. In particular, inner sleeve 101 has a cylindrical form that is open on one end in order to slide over the top end of the astrophotography camera and that is partially closed on the opposite end to rest against the top end of the astrophotography camera.

Inner sleeve 101 may be three-dimensionally printed, injection molded, or manufactured using other manufacturing or printing techniques. For instance, a three-dimensional printer may generate inner sleeve 101 via an additive manufacturing or printing process in which 0.2 millimeters (mm) of inner sleeve 101 are added from the bottom up in each additive pass.

Inner sleeve 101 is made of a soft or flexible plastic. In some embodiments, inner sleeve 101 is generated using thermoplastic polyurethane (TPU).

Inner sleeve 101 has various apertures 201, 203, 205, and 207. Apertures 201, 203, 205, and 207 are cutouts or openings that align with and provide access to various ports, vents, and/or other accessible features of the astrophotography camera (e.g., controls, displays, etc.). For instance, aperture 201 is a side opening about inner sleeve 101 that provides access to a side port about the protected astrophotography camera. In some embodiments, aperture 201 aligns with a side port of the astrophotography camera for accessing or replacing a desiccant cap that absorbs moisture. In some embodiments, apertures 203 align with vents about the sides of the astrophotography camera. The vents may be used to bring in and circulate cold air within the astrophotography camera case and/or to expel heat from the inside the astrophotography camera. Apertures 205 include top openings about inner sleeve 101 that provide access to cable or connectivity ports at the rear or top of the astrophotography camera. For instance, the astrophotography camera may include ports for connecting power and/or data cables that may be used to configure or control the astrophotography camera (e.g., Universal Serial Bus (USB) ports). Aperture 207 is a top or back opening about inner sleeve 101 that aligns with a rear or top vent of the astrophotography camera. Inner sleeve 101 may contain more or fewer apertures and may resize or reposition apertures 201, 203, 205, and 207 based on different port configurations and/or placements of different astrophotography cameras.

As shown in FIGS. 3-4, the outer wall of inner sleeve 101 included slits 209 that run lengthwise from about the top to about the bottom of the outer wall. Each slit 209 may include a concave or triangular vertical cutout or indentation in the outer wall. Slits 209 create grooves into which rails or protrusions disposed in the interior of outer sleeve 103 slide onto. Slits 209 are used to align and hold outer sleeve 103 against inner sleeve 101 and prevent outer sleeve 103 from rotating against inner sleeve 101.

Inner sleeve 101 may be constructed with an inner wall that is connected to an outer wall via a non-solid infill. The total thickness of inner sleeve may range between 1 and 4 mm. The non-solid infill may have an interweaving pattern that creates gaps between the inner wall and the outer wall. The gaps absorb shock, allow the outer wall to distribute a force or energy rather than directly transfer the force or energy from the outer wall to the inner wall, and further allow inner sleeve 101 to bend, compress, and/or flex. In some embodiments, the interweaving pattern separating and connecting the inner wall and the outer wall of inner sleeve 101 corresponds to a gyroid lattice. In some other embodiments, the interweaving pattern separating and connecting the inner wall and the outer wall corresponds to a zigzagging accordion-like lattice.

Figure 5:
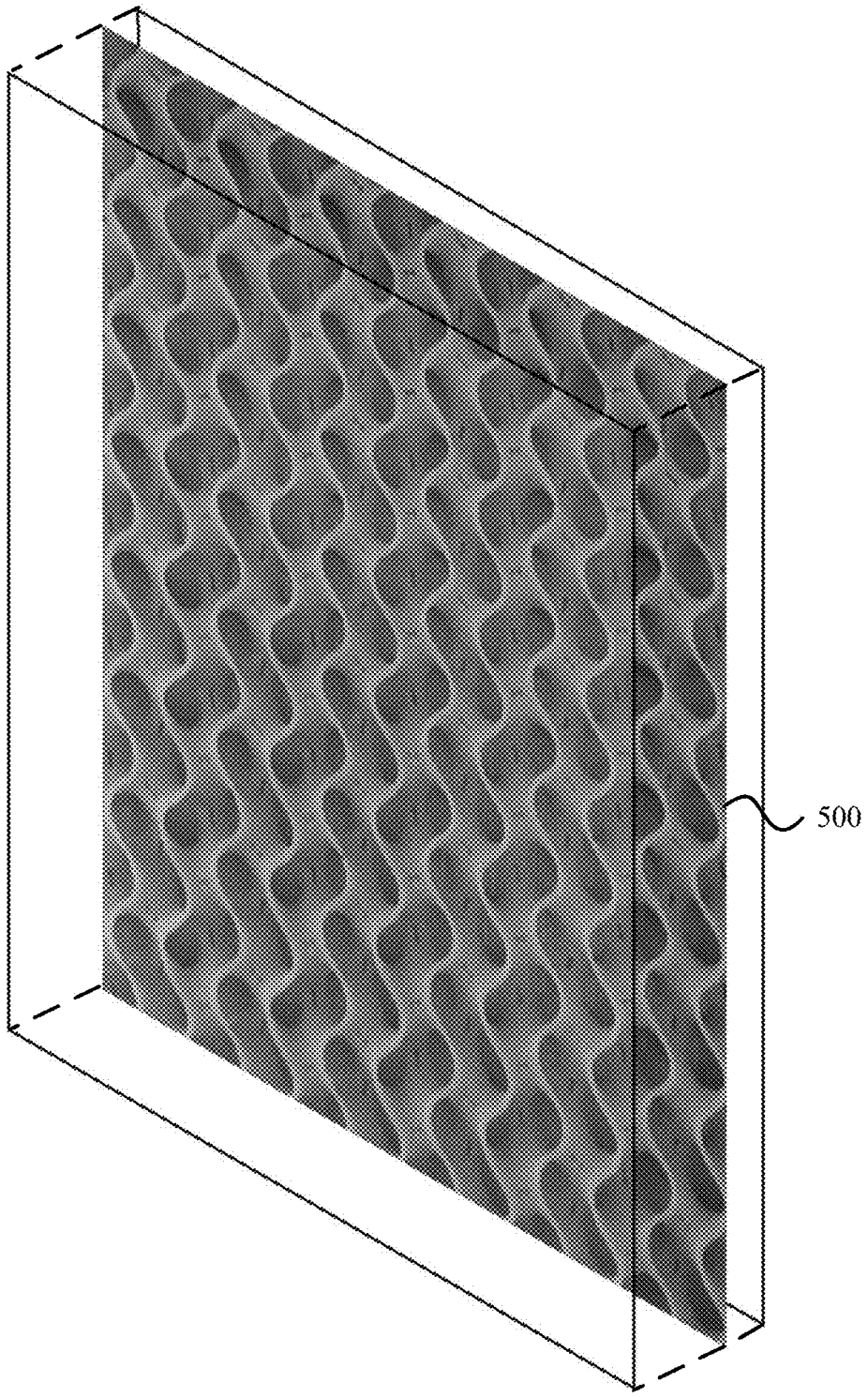
FIG. 5 illustrates an example gyroid lattice as the non-solid infill providing shock absorption between the inner wall and the outer wall of the inner sleeve in accordance with some embodiments presented herein.
Figure 6:
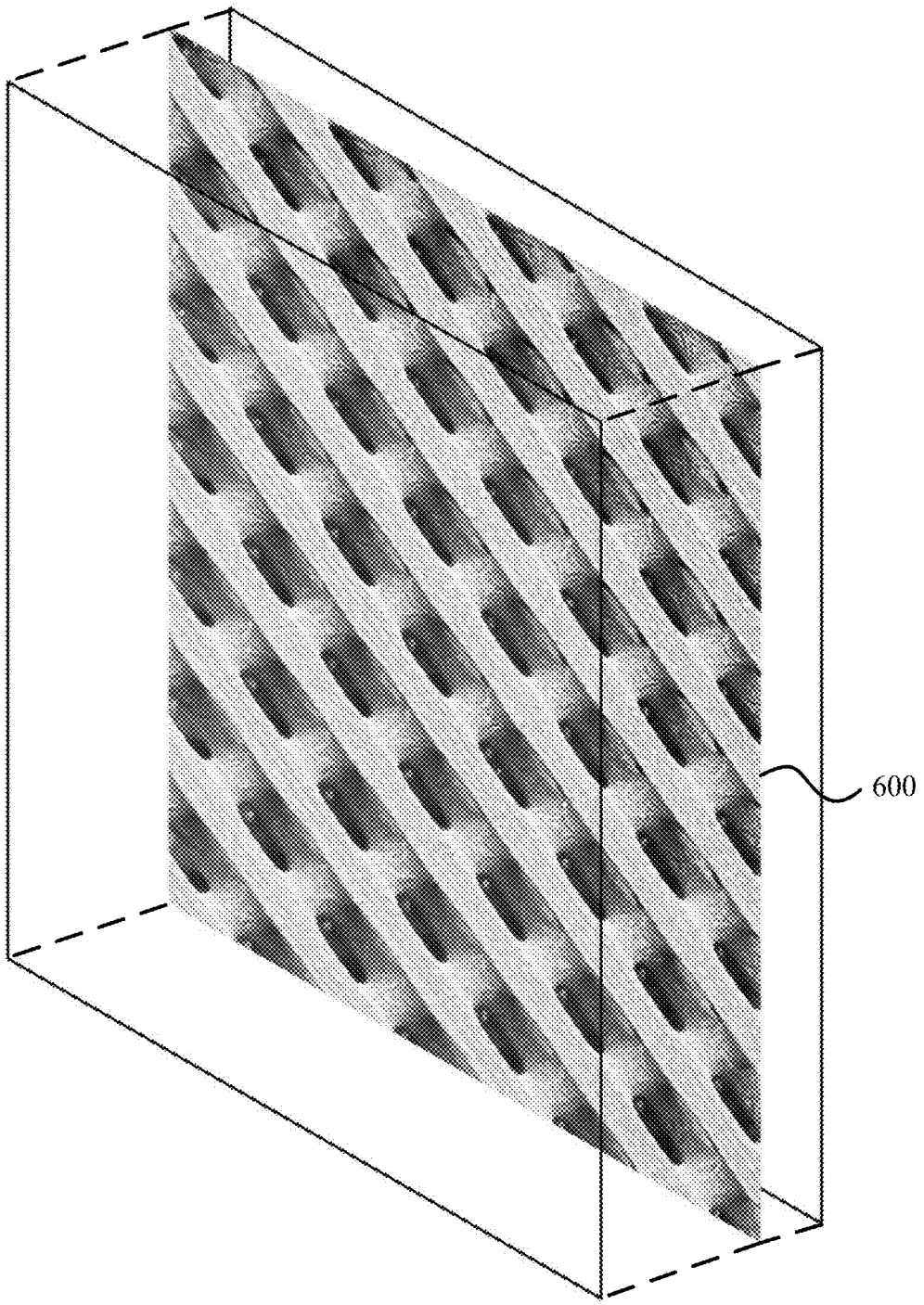
FIG. 6 illustrates an example zigzag lattice as the non-solid infill providing shock absorption between the inner wall and the outer wall of the inner sleeve in accordance with some embodiments presented herein.

FIG. 5 illustrates example gyroid lattice 500 as the non-solid infill providing shock absorption between the inner wall and the outer wall of inner sleeve 101 in accordance with some embodiments presented herein. FIG. 6 illustrates example zigzag lattice 600 as the non-solid infill providing shock absorption between the inner wall and the outer wall of inner sleeve 101 in accordance with some embodiments presented herein.

Figure 7:
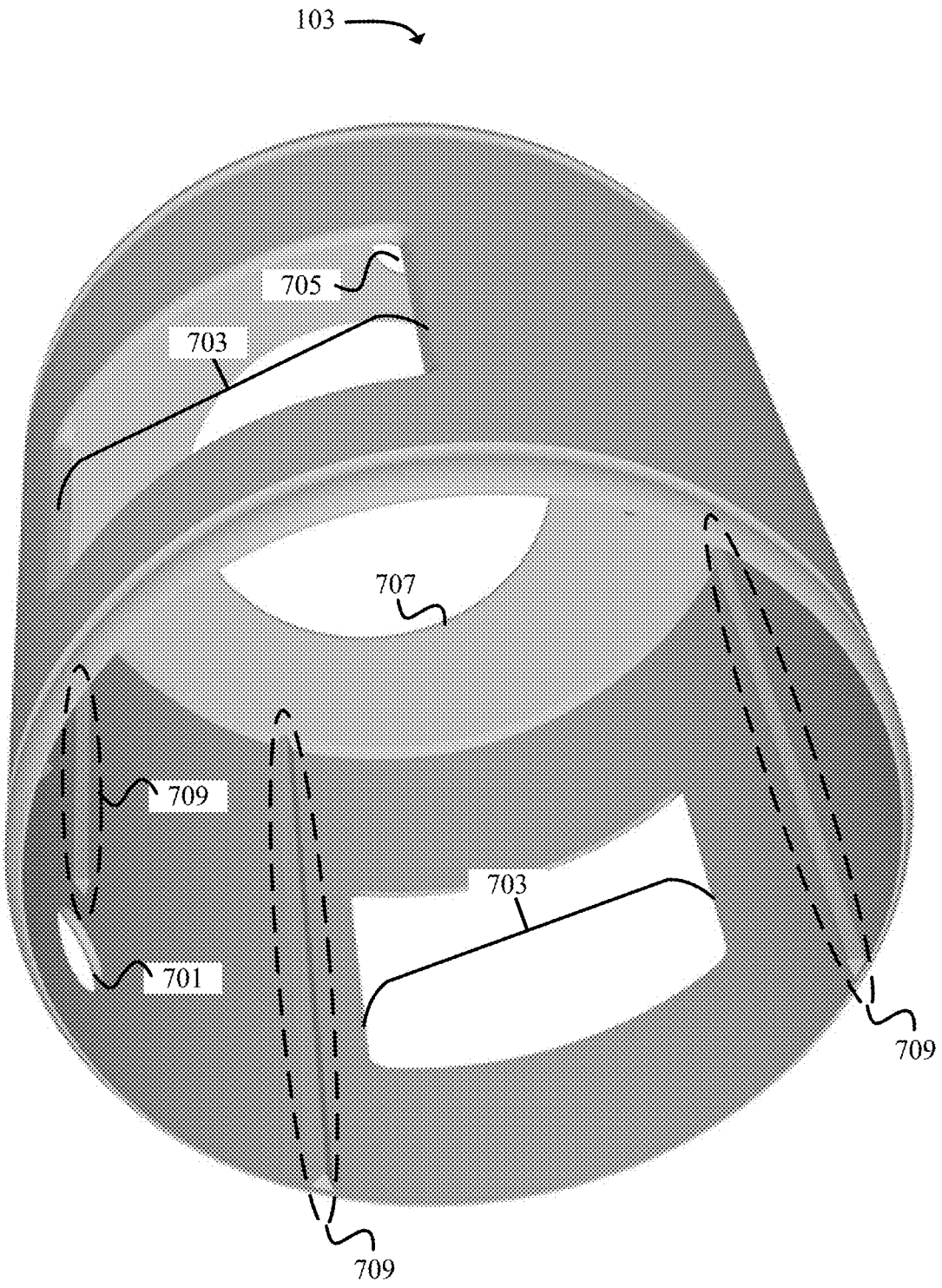
FIG. 7 illustrates a bottom perspective view of the protective case outer sleeve in accordance with some embodiments presented herein.
Figure 8:
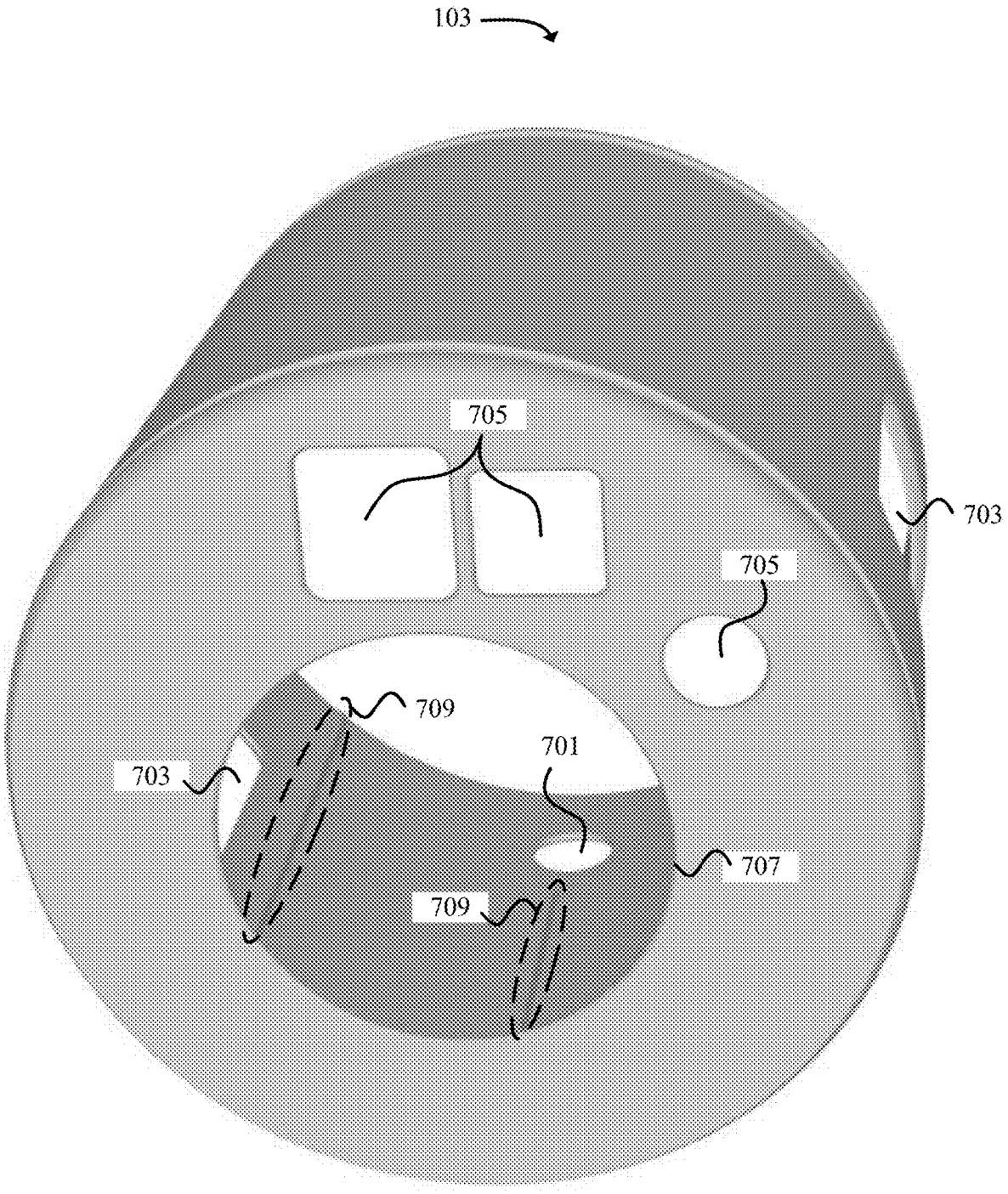
FIG. 8 illustrates a top perspective view of the outer sleeve in accordance with some embodiments presented herein.
Figure 9:
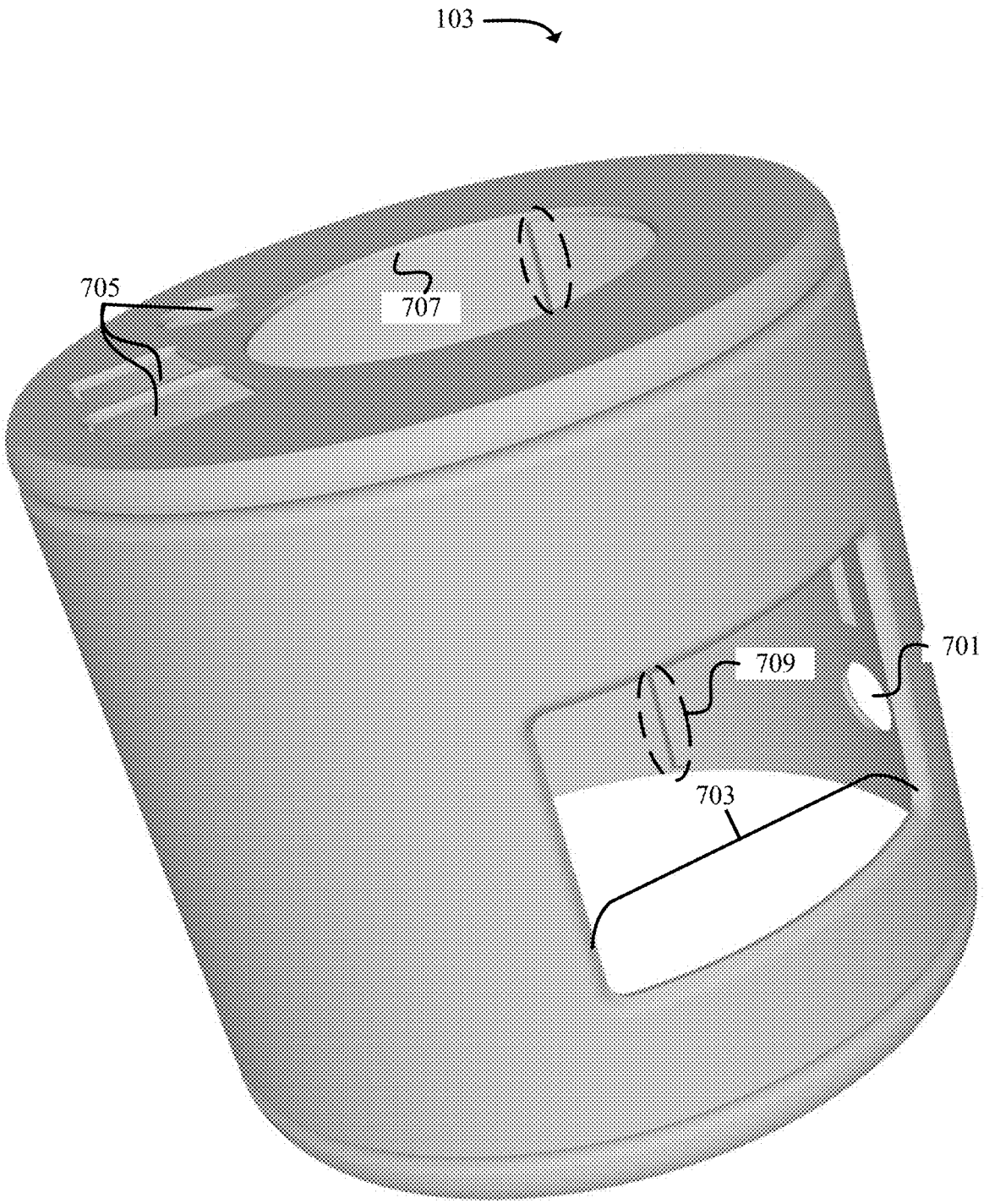
FIG. 9 illustrates the outer sleeve from a side perspective view in accordance with some embodiments presented herein.

FIG. 7 illustrates a bottom perspective view of outer sleeve 103 in accordance with some embodiments presented herein. FIG. 8 illustrates a top perspective view of outer sleeve 103 in accordance with some embodiments presented herein. FIG. 9 illustrates outer sleeve 103 from a side perspective view in accordance with some embodiments presented herein.

As shown in FIGS. 7-9, outer sleeve 103 is a second cylindrical housing that mirrors the shape and dimensions of inner sleeve 101 and has apertures 701, 703, 705, and 707 that align with apertures 201, 203, 205, and 207 of inner sleeve 101 respectively. To maintain the alignment of the apertures, outer sleeve 103 includes rails 709 about its interior. Rails 709 are vertical protrusions (e.g., triangular in shape) that align with slits 209 about the exterior of inner sleeve 101. Specifically, rails 709 slide into slits 209 to prevent outer sleeve 103 and inner sleeve 101 from moving relative to one another.

Outer sleeve 103 provides a hard or protective case over the soft shock-absorbing inner sleeve 101. In some embodiments, outer sleeve 103 is three-dimensionally printed, injection molded, or manufactured using the same or similar manufacturing or printing techniques as inner sleeve 101. However, outer sleeve 103 is made of a different material than inner sleeve 101 in order to give outer sleeve 103 its structural rigidity or hardness. In some embodiments, outer sleeve 103 is made of polyethylene terephthalate glycol-modified (PETG). In some other embodiments, outer sleeve 103 is made of a PETG that is impregnated with carbon fiber. In still some other embodiments, outer sleeve 103 is made of a different rigid plastic.

Outer sleeve 103 is manufactured using the same or similar two wall construction as inner sleeve 101. For instance, outer sleeve 103 has an inner rigid wall with rails 709 protruding inwards or towards the center of outer sleeve 103 and an outer rigid wall that is connected to the inner rigid wall with a non-solid infill. In some embodiments, the non-solid infill separating the inner rigid wall and the outer rigid wall of outer sleeve 103 may have a gyroid lattice structure, a zig-zagging accordion-like lattice, or other interweaving structure that contains gaps. The non-solid infill of outer sleeve 103 is the same PETG or other rigid plastic material as the inner and outer rigid walls. The non-solid infill adds to the structural rigidity of outer sleeve 103.

In some embodiments, outer sleeve 103 distributes or transfers an impact or force that is applied to a certain point about outer sleeve 103 over a larger area of inner sleeve 101 so that the energy of the impact or force is spread out and absorbed by that larger area rather than the point at which it contacts outer sleeve 103. In some embodiments, when a sufficiently large impact or force is applied to outer sleeve 103, outer sleeve 103 dampens the impact or force by cracking or shattering. The cracking or shattering reduces the amount of energy that is transferred from outer sleeve 103 onto inner sleeve 101, thereby providing another layer of shock or energy absorption or protection.

The diameter of outer sleeve 103 is the same or slightly larger than the diameter of inner sleeve 101. The similar diameters allows outer sleeve 103 to apply pressure on inner sleeve 101 when outer sleeve 103 is slid over inner sleeve 101. The applied pressure causes inner sleeve 101 to compress onto the astrophotography camera outer case such that the protective case (e.g., inner sleeve 101 and outer sleeve 103) is snugly coupled to the astrophotography camera, preventing the astrophotography camera from sliding out of the protective case when held or transported.

To improve the fit and attachment of the protective case on the astrophotography camera, inner sleeve 101 may include flexible extensions 211 (see FIGS. 2 and 4) near the bottom of inner sleeve 101. Flexible extensions 211 may include segments of inner sleeve 101 that are separated by small gaps or cutouts. In some embodiments, there is 2 mm of space between each flexible extensions 211. When outer sleeve 103 is fitted or slid onto inner sleeve 101, outer sleeve 103 applies inward pressure on flexible extensions 211. This inward pressure causes flexible extensions 211 to bend inwards and more tightly squeeze around the bottom of the astrophotography camera outer. Flexible extensions 211 thereby provide additional support to prevent the astrophotography camera from detaching or coming apart from the protective case.

The protective case also improves the thermal cooling of the astrophotography camera. The astrophotography camera may have a motorized fan that circulates cooler air from outside within the astrophotography camera case. The protective case improves the thermal cooling by acting as an insulator that prevents the cooler air from escaping through the metallic case, thereby retaining more of the cooler air in the camera case for longer contact with the hot electrical components.

Figure 10:
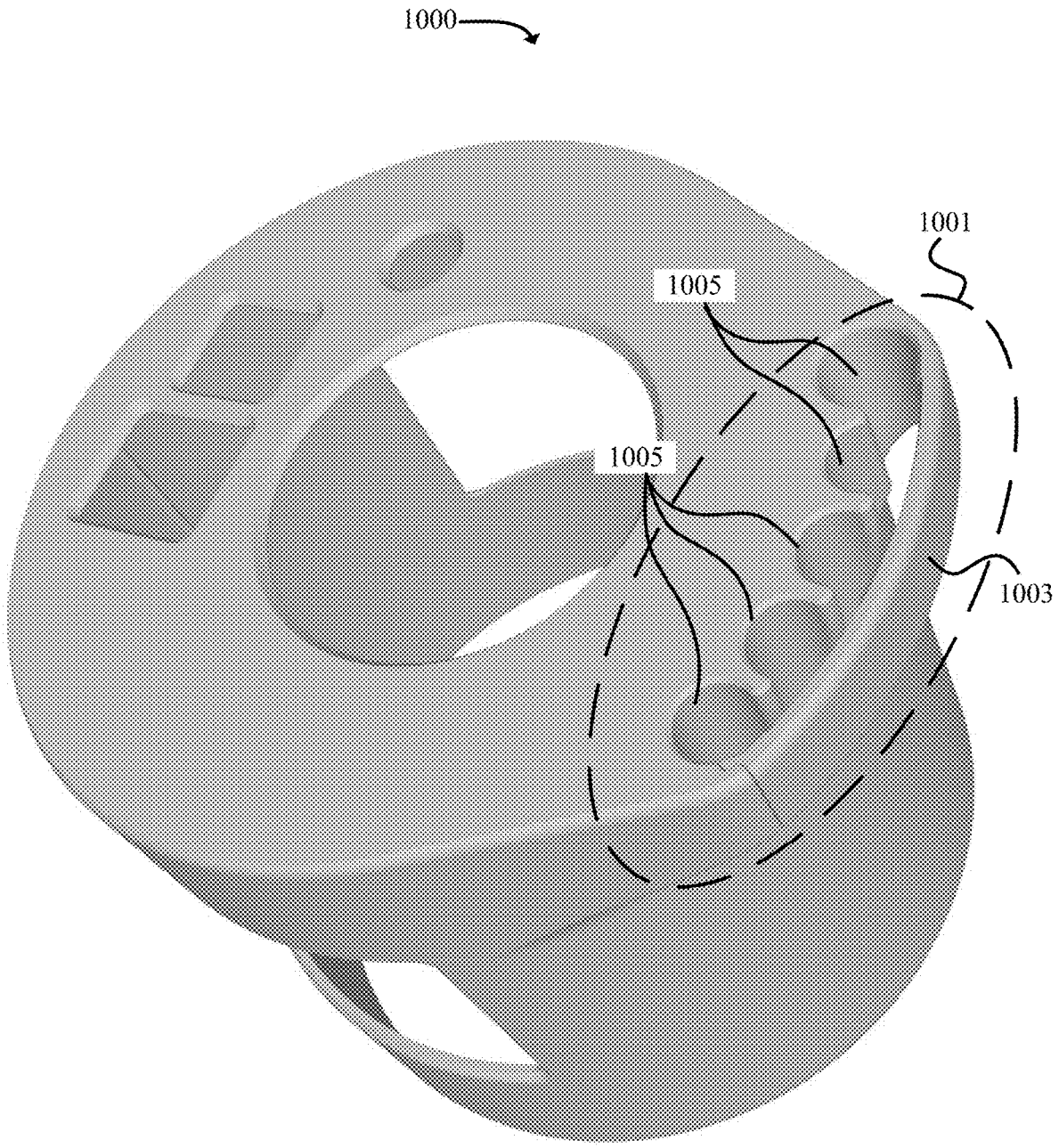
FIG. 10 illustrates a top perspective view of the outer sleeve enhanced with integrated cable management in accordance with some embodiments presented herein.
Figure 11:
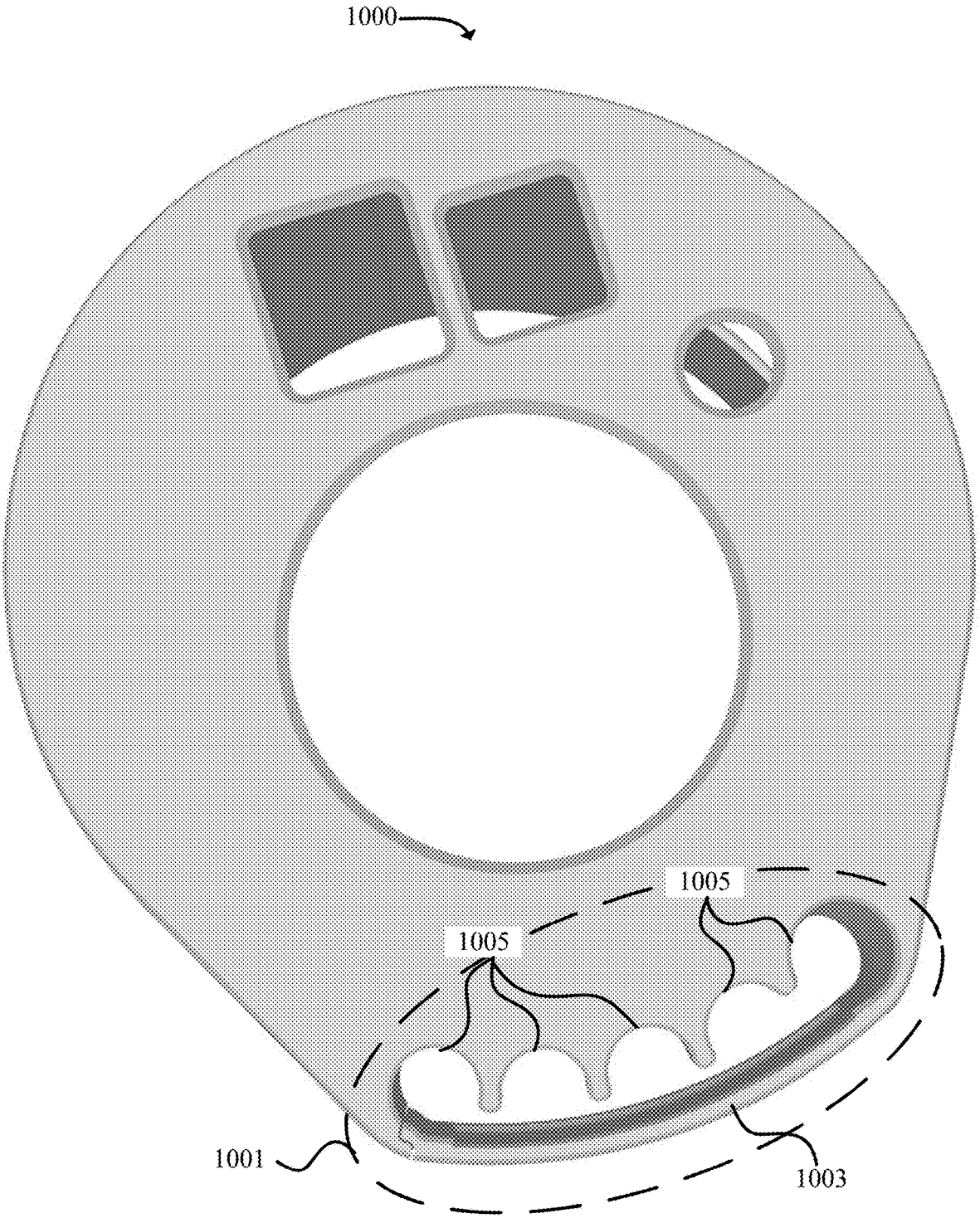
FIG. 11 illustrates a top view of the outer sleeve enhanced with integrated cable management in accordance with some embodiments presented herein.

FIG. 10 illustrates a top perspective view of outer sleeve 1000 enhanced with integrated cable management in accordance with some embodiments presented herein. FIG. 11 illustrates a top view of outer sleeve 1000 enhanced with integrated cable management in accordance with some embodiments presented herein.

As shown in FIGS. 10 and 11, outer sleeve 1000 includes cable management mechanism 1001. Cable management mechanism 1001 is manufactured or printed as part of the top end of outer sleeve 1000. Cable management mechanism 1001 include bendable latch 1003 that opens and closes access to several cable management grooves 1005. In some embodiments, cable management mechanism is 10 mm tall and 2.5 mm thick.

Cable management mechanism 1001 retains cables or wires that connect to and extend out from the astrophotography camera. For instance, data transfer cables, power cables, and/or other wires that are connected to astrophotography camera through top-end apertures 705 may be feed through cable management mechanism 1001 to prevent those cables or wires from dangling on all sides of the astrophotography camera and/or from interfering with usage of the astrophotography camera or the telescope that the astrophotography camera is mounted to. Cable management mechanism 1001 is located on the opposite end of outer sleeve 1000 as top-end apertures 705 in order to prevent a severe or sharp bending of the cables that are connected to the ports exposed through top-end apertures 705.

Bendable latch 1003 and cable management grooves 1005 may be manufactured or printed using the same material as the rest of outer sleeve 1000 (e.g., PETG). Bendable latch 1003 is an arm or flange that extends from one end of outer sleeve 1000 across a front of cable management grooves 1005. Bendable latch 1003 includes a partially-cut segment at an opposite end of outer sleeve 1000. At that same side or opposite end, outer sleeve 1000 includes a lip that extends over the partially-cut segment and that prevents bendable latch 1003 from opening or extending outwards or away from the center of outer sleeve 1000. Bendable latch 1003 may be bent inwards or towards the center of outer sleeve 1000 by pushing or pressing in on bendable latch 1003. Bendable latch 1003 may be bent inwards or towards to open access to cable management grooves 1005. Cables or wires may then be slid past the opening created between the partially-cut segment of bendable latch 1003 and the lip and into cable management grooves 1005. When the inward applied force onto bendable latch 1003 is removed, bendable latch 1003 bends back to contact the lip and retain the inserted cables within cable management grooves 1005.

In some embodiments, the protective case may be manufactured as a one piece solution. In some such embodiments, outer sleeve 103 may be printed directly onto and/or adhered to the outer wall of inner sleeve 101. In some other embodiments, the protective case may be printed to have an inner wall and interweaving non-solid infill made of a flexible plastic (e.g., TPU) and an outer wall made of a rigid plastic (e.g., PETG).

The invention claimed is:

1. A protective case comprising:

an inner sleeve comprising:

an open bottom end, a cylindrical housing, a top end, a first plurality of apertures disposed about the cylindrical housing and the top end, and a set of slits extending vertically about an exterior of the cylindrical housing, wherein the inner sleeve is composed of a flexible plastic; and an outer sleeve comprising:

a second plurality of apertures, and a set of rails about an interior of the outer sleeve that slide into the set of slits about the exterior of the inner sleeve, wherein the second plurality of apertures align with the first plurality of apertures in response to sliding the set of rails of the outer sleeve onto the set of slits of the inner sleeve, and wherein the outer sleeve is composed of a rigid plastic.

2. The protective case of claim 1, wherein the cylindrical housing comprises an inner wall, an outer wall, and a non-solid infill between the inner wall and the outer wall, wherein each of the inner wall, the outer wall, and the non-solid infill is composed of the flexible plastic.

3. The protective case of claim 2, wherein the outer sleeve comprises an open bottom end, a cylindrical housing, and a top end, and wherein the cylindrical housing and the top end of the outer sleeve have a form that match a form of the cylindrical housing and the top end of the inner sleeve.

4. The protective case of claim 2, wherein the outer sleeve further comprises an inner wall, an outer wall, and the non-solid infill between the inner wall and the outer wall, wherein each of the inner wall, the outer wall, and the non-solid infill of the outer sleeve is composed of the rigid plastic.

5. The protective case of claim 2, wherein the non-solid infill is a gyroid lattice.

6. The protective case of claim 2, wherein the non-solid infill has a zigzag structure with a plurality of gaps.

7. The protective case of claim 1, wherein the inner sleeve further comprises:

a plurality of flexible extensions at a bottom of the cylindrical housing, wherein the plurality of flexible extensions comprise segments of the inner sleeve that are separated by gaps or cutouts.

8. The protective case of claim 1, wherein the set of slits correspond to indentations that form grooves for the set of rails.

9. The protective case of claim 1, wherein the outer sleeve further comprises:

a plurality of grooves about a top side of the outer sleeve;

a bendable latch that extends across the plurality of grooves from one side of the outer sleeve; and a lip at an opposite side of the outer sleeve that permits an inward bending of the bendable latch and prevents an outward bending of the bendable latch.

10. The protective case of claim 1, wherein the flexible plastic is thermoplastic polyurethane (TPU), and wherein the rigid plastic is polyethylene terephthalate glycol-modified (PETG).

11. The protective case of claim 1, wherein the outer sleeve applies inward pressure on the inner sleeve that causes the inner sleeve to retain its position against a cylindrical case that is inset within the inner sleeve.

12. A protective case comprising:

a cylindrical housing with an open bottom end and a partially-closed top end, the cylindrical housing comprising:

a plurality of apertures about the partially-closed top end and sides of the cylindrical housing;

an inner wall;

an outer wall; and a non-solid infill that connects the inner wall to the outer wall and that comprises a plurality of gaps between the inner wall and the outer wall.

13. The protective case of claim 12, wherein the inner wall is made of a flexible plastic and the outer wall is made of a rigid plastic.

14. The protective case of claim 12, wherein the non-solid infill is a gyroid lattice.

15. The protective case of claim 12, wherein the non-solid infill has a zigzag structure with a plurality of gaps.

16. The protective case of claim 12, wherein the cylindrical housing is a first cylindrical housing with a set of slits that run vertically about an exterior of the outer wall; and wherein the protective case further comprises a second cylindrical housing with a set of rails that run vertically about an interior of the second cylindrical housing and that slide into the set of slits in order to attach the second cylindrical housing over the first cylindrical housing.

17. The protective case of claim 12, wherein one or more of the plurality of apertures about the sides of the cylindrical housing align with vents about sides of a camera that is protected by the protective case.

18. The protective case of claim 17, wherein a set of the plurality of apertures about the partially-closed top end of cylindrical housing align with cable ports located on a top side of the camera.

* * * * *